US008140251B2

(12) United States Patent
Paolini et al.

(10) Patent No.: US 8,140,251 B2
(45) Date of Patent: Mar. 20, 2012

(54) MANAGEMENT OF TRAFFIC SIGNALS AT ROAD INTERSECTION TO AVOID BLOCKING VEHICLES

(75) Inventors: Michael A Paolini, Austin, TX (US); Yvonne P Stoetzel, Round Rock, TX (US); Cristi N Ullmann, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/195,167

(22) Filed: Aug. 1, 2011

(65) Prior Publication Data

US 2011/0288758 A1 Nov. 24, 2011

Related U.S. Application Data

(62) Division of application No. 11/381,457, filed on May 3, 2006.

(51) Int. Cl.
*G06G 7/76* (2006.01)
*G08G 1/00* (2006.01)

(52) U.S. Cl. ..... 701/117; 701/96; 701/118; 701/119; 701/301; 701/302

(58) Field of Classification Search ..... 701/96, 701/117, 118, 119, 301, 302; 340/901, 907, 340/910, 917, 919, 995.13
See application file for complete search history.

(56) References Cited

U.S. PATENT DOCUMENTS 3,241,108 A * 3/1966 Du Vivier ..... 340/919
3,688,254 A * 8/1972 Uryu et al. ..... 340/923
5,798,949 A * 8/1998 Kaub ..... 703/6
6,243,026 B1 * 6/2001 Jones et al. ..... 340/906
6,281,808 B1 * 8/2001 Glier et al. ..... 340/933
6,662,141 B2 * 12/2003 Kaub ..... 702/181
6,759,948 B2 * 7/2004 Grisham et al. ..... 340/435
6,917,284 B2 * 7/2005 Grisham et al. ..... 340/435
7,133,767 B2 * 11/2006 Ogino et al. ..... 701/200
7,148,791 B2 * 12/2006 Grisham et al. ..... 340/435
7,209,051 B2 * 4/2007 Shankwitz et al. ..... 340/938
7,274,988 B2 * 9/2007 Mukaiyama ..... 701/301
7,383,126 B2 * 6/2008 Takahashi ..... 701/211
7,454,037 B2 * 11/2008 Higgins ..... 382/103
2002/0082806 A1 * 6/2002 Kaub ..... 702/182
2003/0016143 A1 * 1/2003 Ghazarian ..... 340/901
2003/0058131 A1 * 3/2003 Grisham et al. ..... 340/907
2003/0130788 A1 * 7/2003 Akashi ..... 701/209
2004/0128062 A1 * 7/2004 Ogino et al. ..... 701/200
2004/0181339 A1 * 9/2004 Mukaiyama ..... 701/301
2005/0140523 A1 * 6/2005 Publicover ..... 340/907
2005/0156757 A1 * 7/2005 Garner ..... 340/907
2005/0174257 A1 * 8/2005 Shankwitz et al. ..... 340/909
2007/0069920 A1 * 3/2007 Hakki et al. ..... 340/907

* cited by examiner

*Primary Examiner* — Khoi Tran
*Assistant Examiner* — Jorge Peche
(74) *Attorney, Agent, or Firm* — J. B. Kraft; David A. Mims

(57) ABSTRACT

A computer controlled system for managing traffic signals at the intersection of at least two traffic lanes to avoid collisions between motor vehicles in intersecting lanes. An implementation with means for controlling traffic signals at the intersection to permit vehicles in each of the intersecting traffic lanes a time period to pass through the intersection, means for detecting the presence of a vehicle in the intersection beyond said permitted time period, and means responsive to a detection of the presence of the vehicle, for controlling the traffic signals to stop other vehicles from passing through the intersection.

8 Claims, 7 Drawing Sheets

MANAGEMENT OF TRAFFIC SIGNALS AT ROAD INTERSECTION TO AVOID BLOCKING VEHICLES

TECHNICAL FIELD

The present invention relates to automated traffic control signal systems, and particularly to avoiding collisions when a motor vehicle is improperly blocking an intersection of two or more traffic roads or lanes.

BACKGROUND OF RELATED ART

Automated traffic signal (light) systems have been in existence for almost a century. The art of automated traffic control is extensively developed. Some examples of conventional prior art are U.S. Pat. No. 3,688,254, issued in 1972, and U.S. Pat. No. 6,281,808, issued in 2001. It is well known that despite the increasing availability of computer controlled data processing resources over the past generation, annual traffic deaths in the United States still exceed 40,000. A good percentage of such deaths result from collisions at intersections of two or more roads or lanes. One of the reasons for higher fatality rates in intersection collisions is that the collision frequently involves a direct crash into a side of at least one of the vehicles. The side of a vehicle is the most vulnerable part of the vehicle. Until recently, standard automobiles did not have side airbags. Even now, when such side airbags are available, very few vehicles are equipped with them. To date, despite the extensively developed prior art in traffic control and, particularly, traffic control at intersections, collisions at intersections remain a leading cause of traffic deaths.

SUMMARY OF THE PRESENT INVENTION

The present invention provides an advance in intersection traffic control that is easy to implement on existing vehicle traffic control apparatus and intends to reduce possibilities for collision when an automobile or other motor vehicle is improperly blocking an intersection of traffic signal controlled roads or lanes.

The invention involves a computer controlled system for managing traffic signals at the intersection of at least two traffic lanes to avoid collisions between motor vehicles in intersecting lanes. An implementation is provided comprising the combination of means for controlling traffic signals at the intersection to permit vehicles in each of the intersecting traffic lanes a time period to pass through the intersection, means for detecting the presence of a vehicle in the intersection beyond said permitted time period, and means responsive to a detection of the presence of the vehicle, for controlling the traffic signals to stop other vehicles from passing through the intersection. The invention is applicable to traffic control systems having means for alternating said traffic signals to permit time periods to pass through for vehicles in each of the intersecting traffic lanes, and wherein the means responsive to the detection of the vehicle in the intersection extends the alternate time period for pass through of the vehicle until the vehicle is no longer present in the intersection.

In accordance with a further aspect of the invention, apparatus for detecting the presence of a vehicle in the intersection is enabled to detect the presence of the vehicle of such predetermined time beyond the time period to indicate a stalled vehicle, and further including means responsive to such detection of a stalled vehicle to control the traffic signals in all intersecting lanes so as to prevent collisions with said stalled vehicle.

There is another aspect of the invention including apparatus for dynamically predicting the potential presence of an approaching vehicle in the intersection beyond the time period combined with means responsive to this prediction of the presence of said vehicle for controlling the traffic signals to stop other vehicles from passing through the intersection.

BRIEF DESCRIPTION OF THE DRAWINGS

The present invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENT

In FIGS. 1 through 6, there will be respectively illustrated plan or overviews of three different types of traffic signal controlled intersections. For each of the three illustrative intersections, there will shown a view under normal traffic flow and then a view with a vehicle blocking the intersection, together with an explanation of how the present invention adjusts for the blocking vehicle in each situation. The sensing of and programming to deal with each problem situation will then be subsequently described with respect to FIGS. 8 through 10.

Figure 1:
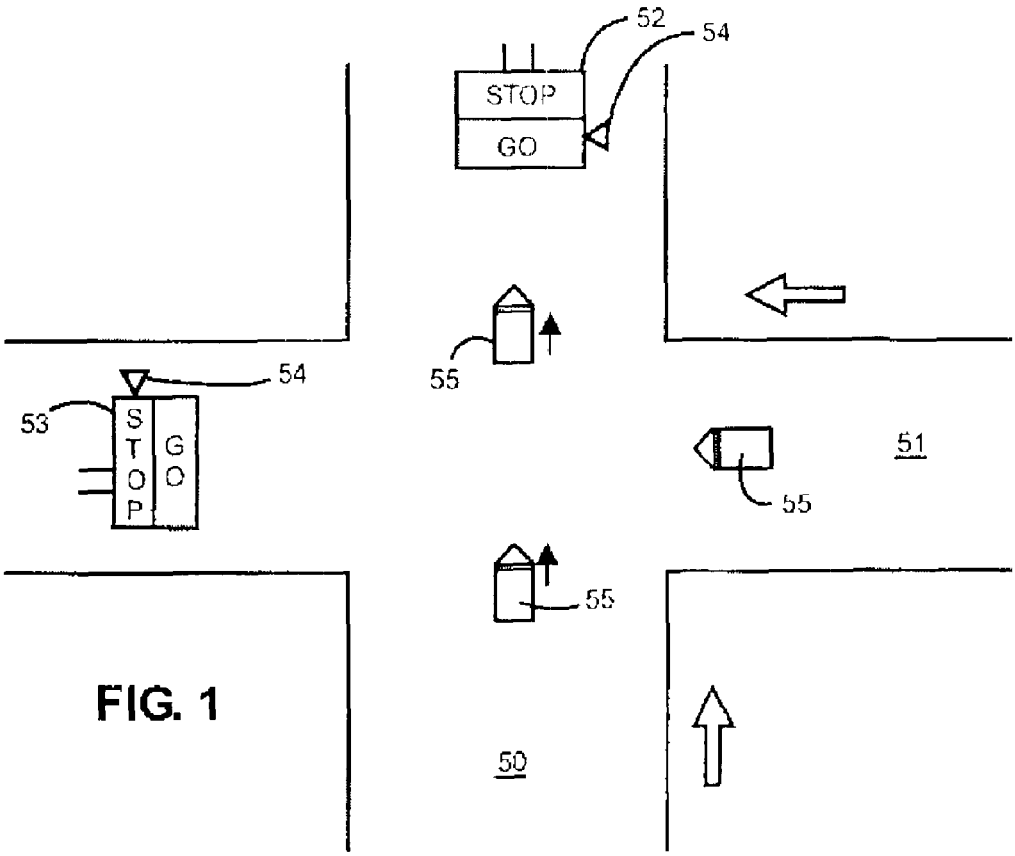
FIG. 1 is a plan or map view above an illustrative intersection of a pair of one-way roads or lanes under normal flow with automated Stop/Go signal control.

Referring now to FIG. 1, an intersection of two one-way roads 50 and 51 is shown. Vehicles 55 in each are moving or stopped in accordance with the status of respective controlled signal lights 52 and 53. Arrowheads 54 point to the state of each of the signal lights. At this point in time, signal light 52 is in the Go state for road 50, and consequently, signal light 53 is in the Stop state for road 51. Each of the controlled signal lights are periodically alternated in conventional cycles.

Figure 2:
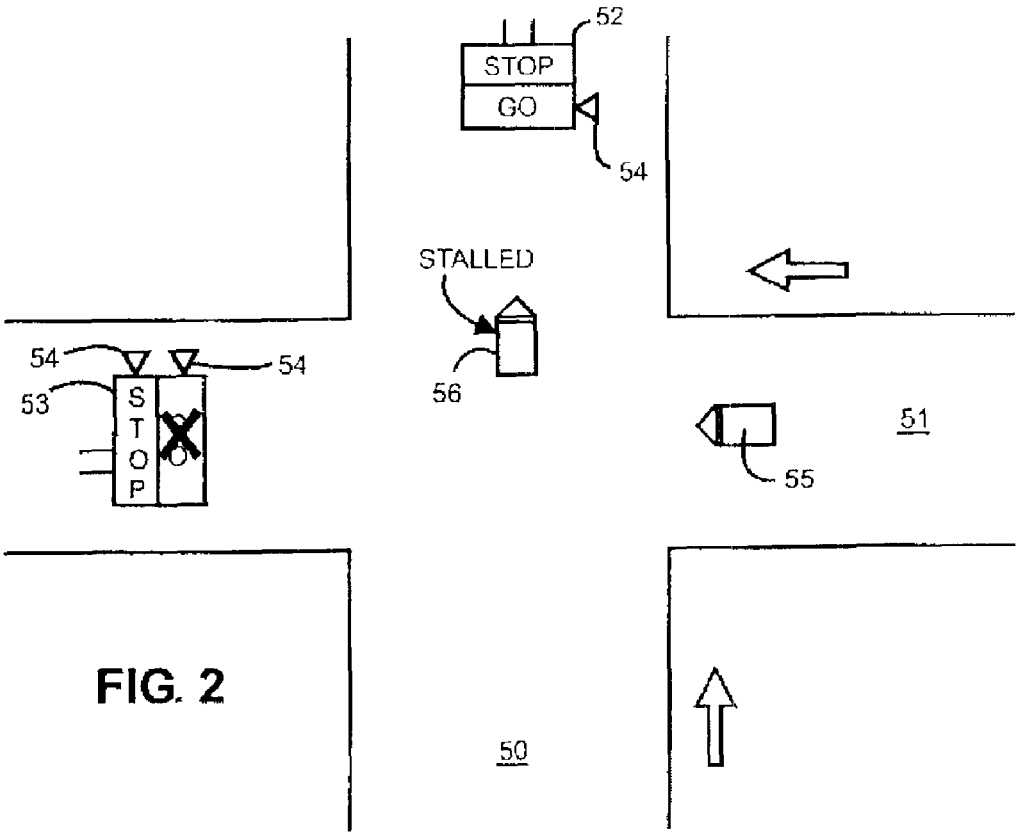
FIG. 2 is the plan intersection view of FIG. 1 showing the response according to the present invention after a stalled vehicle is blocking the intersection.

FIG. 2 shows the intersection of FIG. 1 except that instead of a normal traffic situation, there is an automobile 56 stalled in the intersection. As will be set forth in greater detail hereinafter, automobile 56 is considered to be stalled since it has remained in the intersection beyond the change in signal permitting vehicles to proceed on road 50. The present invention provides for a short time period to cover a vehicle such as automobile 56 racing through the intersection "trying to beat the light". During this time, the Go state of traffic signal light 53 that normally should turn on as indicated by head 54 will be prohibited for a short time period dT. At the end of this short period, if the vehicle is still detected in the intersection as in FIG. 2, the vehicle will be considered to be stalled and the traffic signals in both directions, 52 and 53, will be held at Stop until the stalled vehicle 56 is moved out of the intersection.

Figure 3:
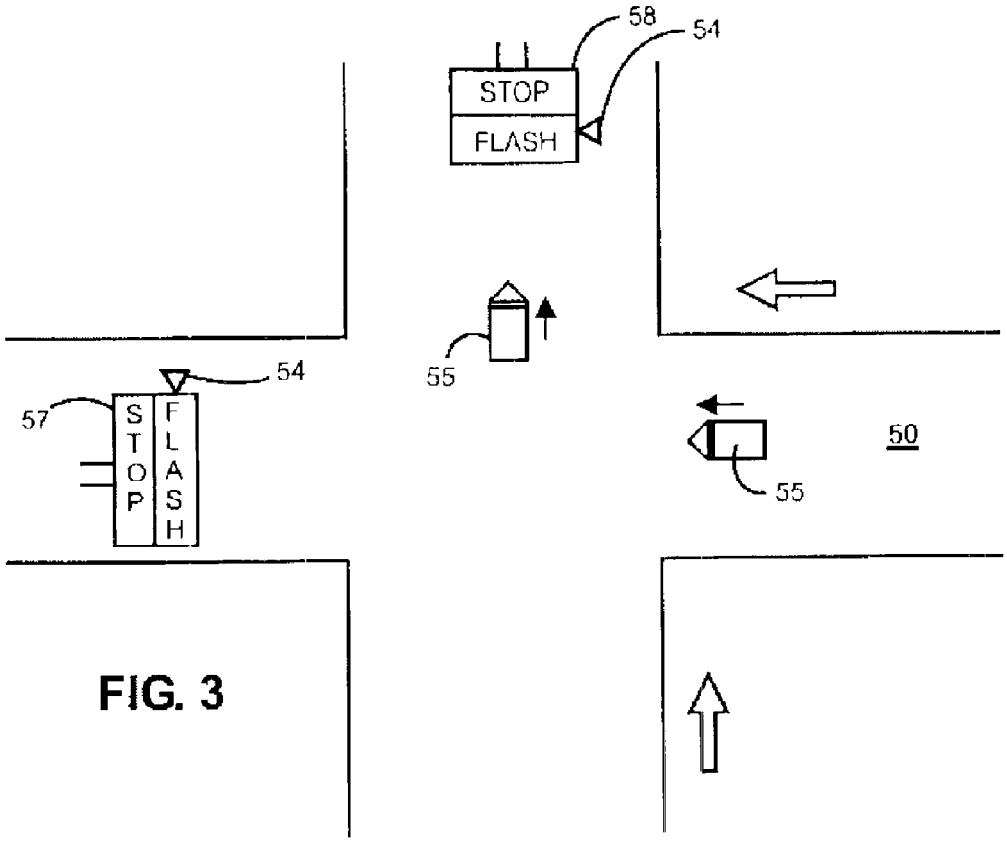
FIG. 3 is a plan or map view above an illustrative intersection of a pair of one-way roads or lanes with normal flow under automated Flashing signal control.

FIG. 3 is an intersection of a pair of one-way roads or lanes, as in FIG. 1, under normal flow except that the traffic signals are under automated flashing signal control, e.g. both traffic signals 57 and 58 flash red requiring a vehicle 55 to make a full stop in both roads before proceeding through the intersection; or one or both of the road signals may flash yellow for slow and cautious crossing of the intersection.

Figure 4:
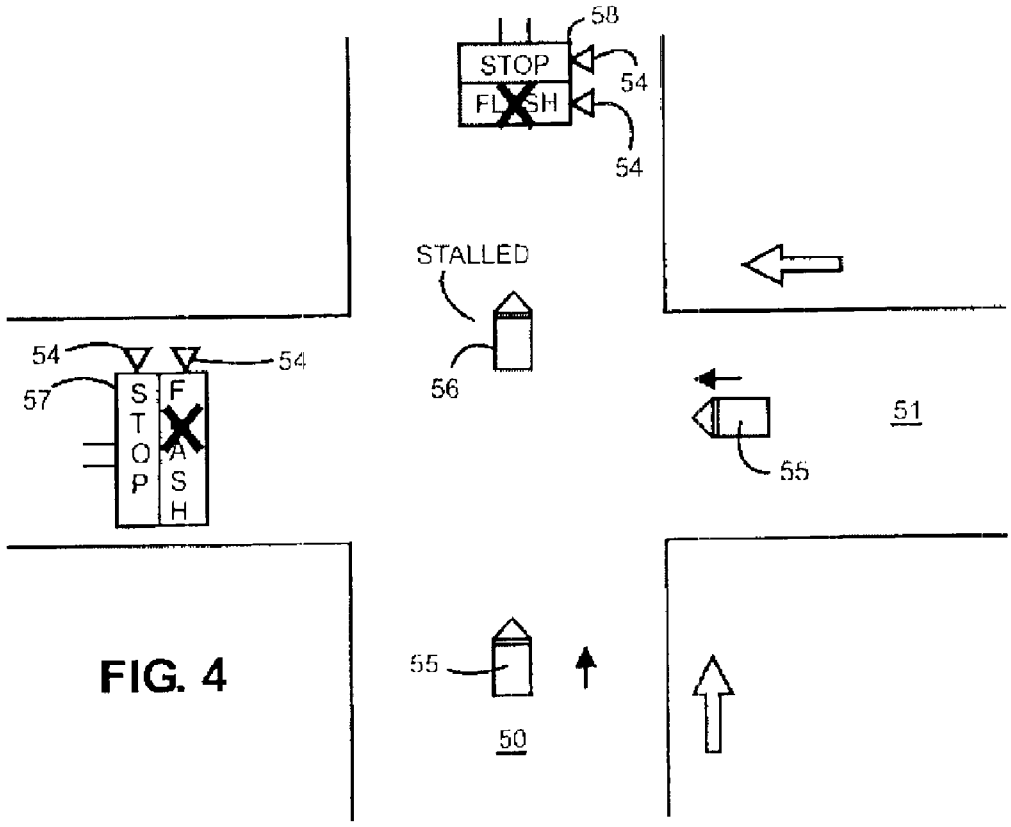
FIG. 4 is the plan intersection view of FIG. 3 showing the response according to the present invention after a stalled vehicle is blocking the intersection.

FIG. 4 shows the intersection of FIG. 3 except that instead of a normal traffic situation, there is an automobile 59 stalled in the intersection. Automobile 56 is permitted a brief time period dT before it is considered to be stalled. During this time, the flashing states of traffic signal lights 57 and 58 may normally be turned on as indicated by heads 54. At the end of this short period, if the vehicle 59 is still detected in the intersection as in FIG. 4, the vehicle will be considered to be stalled. The flashing of the traffic signals in both directions 57 and 58 will be prohibited and both the traffic signals 57 and 58 will be held at Stop until the stalled vehicle 56 is moved out of the intersection.

Figure 5:
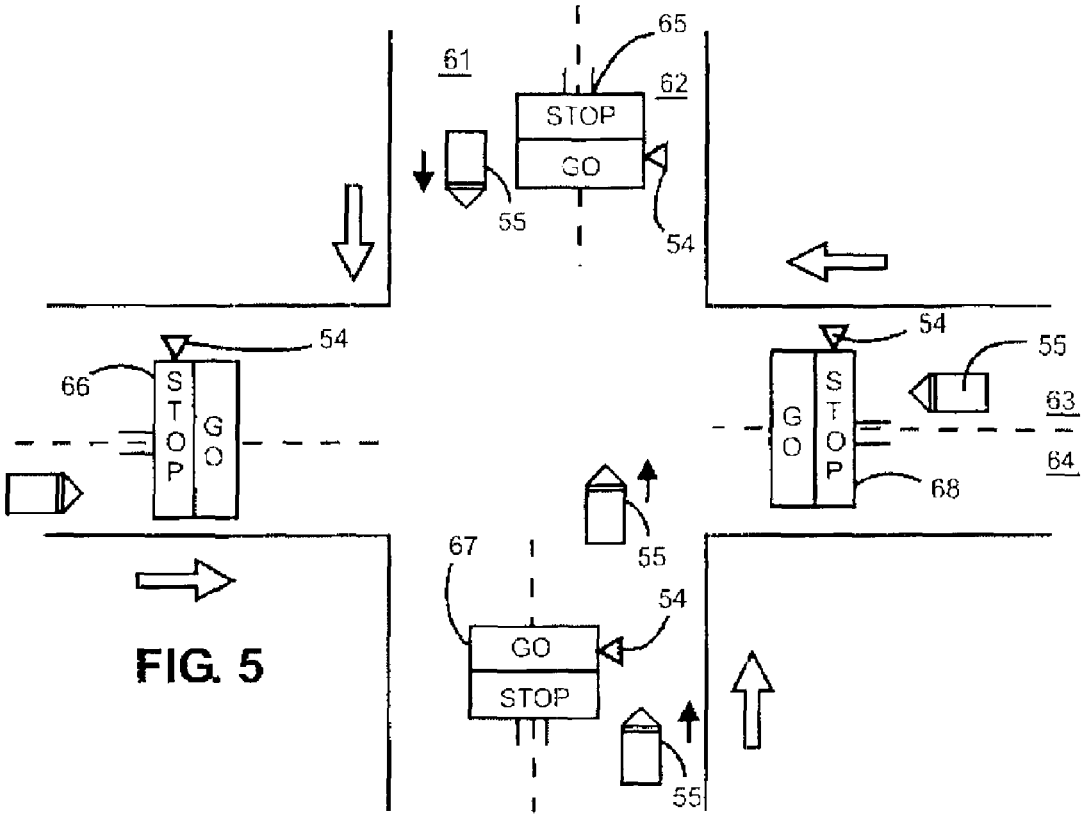
FIG. 5 is a plan or map view above an illustrative intersection of a pair of two-way roads or lanes under normal flow with automated Stop/Go signal control.
Figure 6:
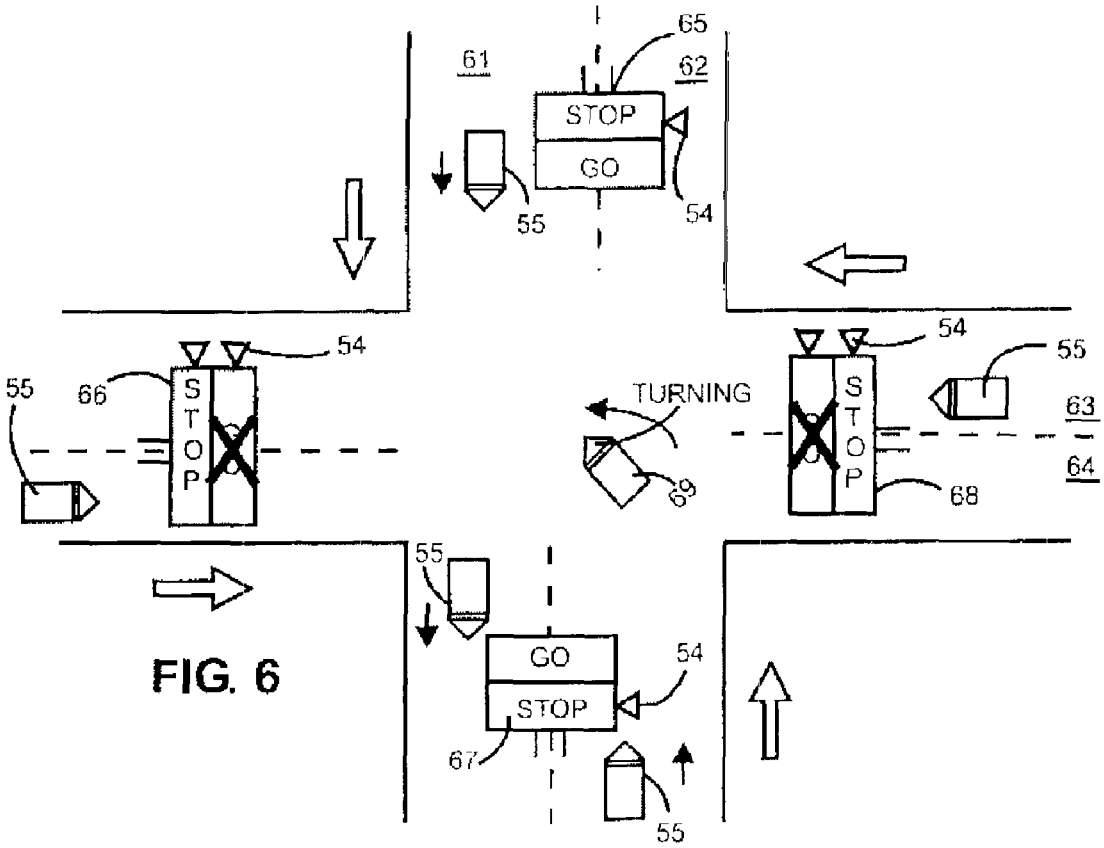
FIG. 6 is the plan intersection view of FIG. 5 showing the response according to the present invention after a stalled vehicle is blocking the intersection.

FIGS. 5 and 6 are similar views and situations as FIGS. 1 and 2, respectively, except that instead of an intersection of a pair of one-way roads, the intersection is of a pair of two-way roads or lanes under normal flow with automated Stop/Go signal control. As in FIGS. 1 and 2, vehicles 55 in each in both directions are either moving or stopped in accordance with the status of respective controlled signal light pairs 65 and 67 or 66 and 68. Arrowheads 54 point to the state of each of the signal lights. At the point in time in FIG. 5, signal light pairs 65 and 67 are in the Go state for two lane road 61/62, and consequently, signal light pairs 66 and 68 are in the Stop state for two lane road 63/64. Each of the controlled signal lights are periodically alternated in conventional cycles.

FIG. 6 shows the intersection of FIG. 5 except that instead of a normal traffic situation there is an automobile 69 in the intersection. As will be set forth in greater detail hereinafter, automobile 69 may be stalled since it has remained in the intersection beyond the change in signal permitting vehicles to proceed on road 50. The present invention provides for a short time period to cover a vehicle such as automobile 69 racing through the intersection "trying to beat the light", and as may be the case in FIG. 6, the vehicle 69 has been trying to make a left turn but has been unable to do so because of a constant flow of oncoming vehicles in lane 61. During this time, the Go states of traffic signal lights 66 and 68 that normally should turn on as indicated by head 54 will be prohibited for a short time period dT. At the end of this short period, if the vehicle is still detected in the intersection, the vehicle will be considered to be stalled, and the traffic signals in both directions, 65/67 and 66/68 will be held at Stop until the stalled vehicle is moved out of the intersection.

Figure 7:
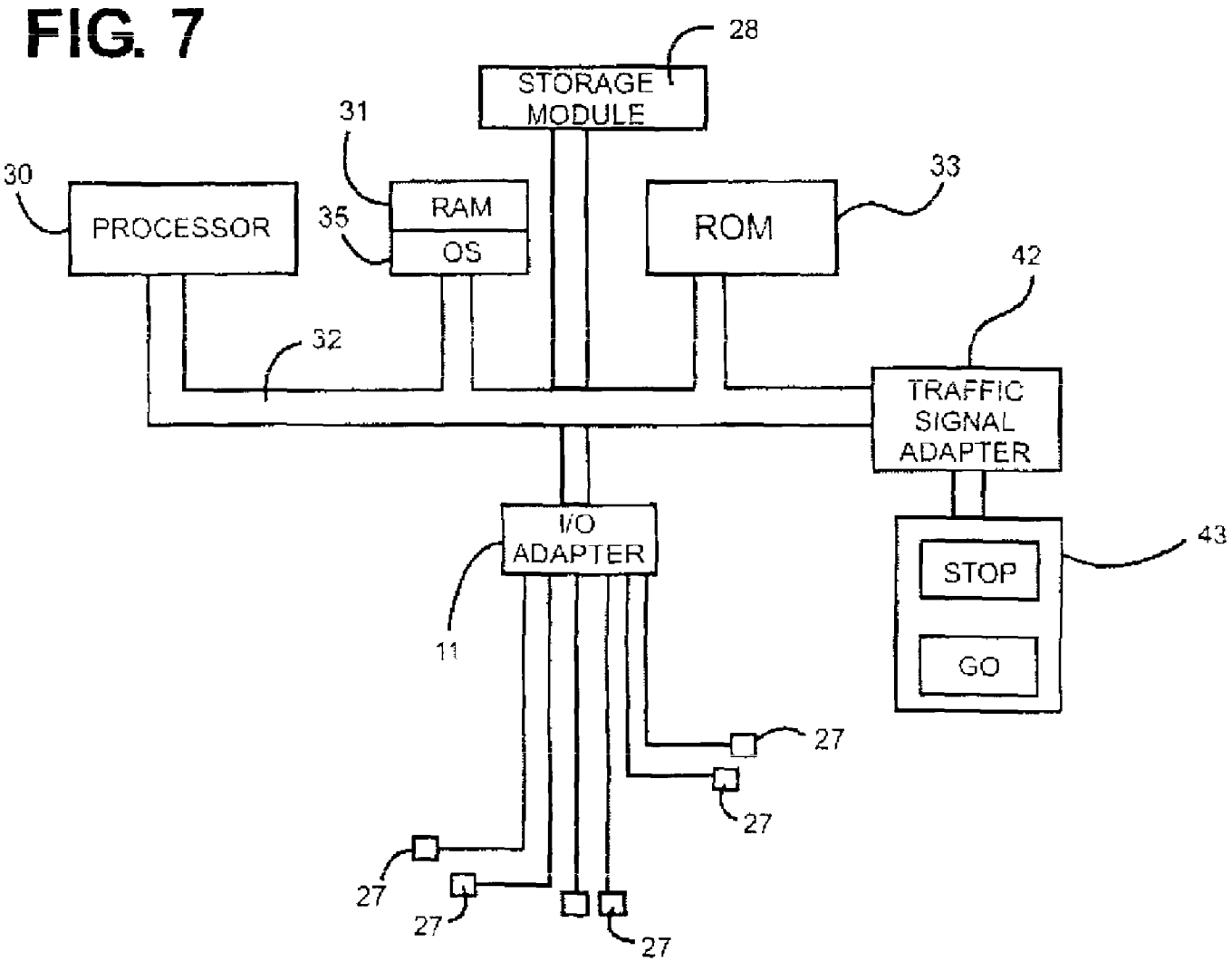
FIG. 7 is a block diagram of a generalized data processing system including a central processor unit that provides a very general illustration of the computer control of traffic signals in response to sensing apparatus as used in the present invention.

Referring now to FIG. 7, there is provided a diagrammatic view of an illustrative computer control system that may function to coordinate and control traffic signals at an intersection in the practice of the present invention. This control unit may be local at the intersection or it may be situated remote from the intersection as part of a more extensive regional traffic pattern control server. In either event, the functional elements will be equivalent. Conventional sensors 27 are positioned in dozens of places in predetermined patterns throughout the intersection. For aspects of the present invention they may be positioned in the roads, hundreds of yards from the intersection. The sensors may be embedded in the roads or positioned above the roads. Preferably, the sensors are some form of light sensors from which light patterns may determine which, in turn, may be interpreted to determine the presence of vehicles. Traffic sensor hardware is a well developed technology in the art. Sensors 27 are connected via I/O adapter 11 to a central processing unit 30 that, in turn, is interconnected to various other components by system bus 32 and coordinates the operations. An operating system 35 that runs on processor 30 provides control and is used to coordinate the functions of the various components of the control system. The Operating System (OS) 35 is stored in Random Access Memory (RAM) 31. The programs for the various automobile monitor and control functions, including those of the present invention, may be stored in Read Only Memory (ROM) 33 and moved into and out of RAM to perform their respective functions. The information from sensors 27 may also be stored in a central storage unit 28 where it will be available for advanced diagnostics for traffic control. The control signal unit 43 is controlled by the processor 30 through traffic signal adapter 42.

Figure 8:
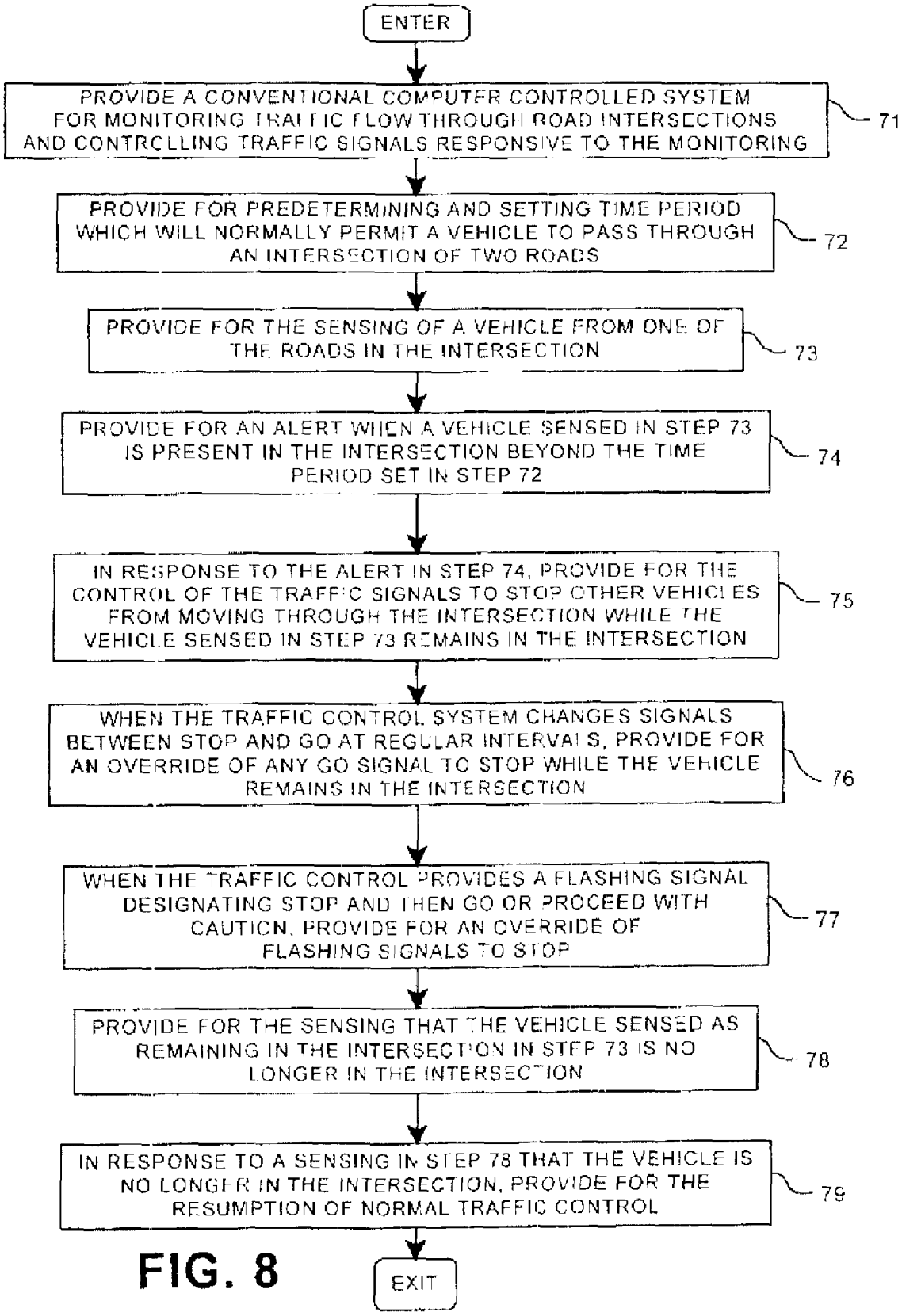
FIG. 8 is an illustrative flowchart describing the setting up of the elements needed for the program of the invention for controlling traffic signals in response to a vehicle blocking a controlled intersection.

Now, with reference to the programming shown in FIG. 8, there will be described how the system and programs of the present invention are set up. There is provided a conventional computer controlled system for monitoring traffic flow through a road intersection and for controlling traffic signals responsive to the monitoring, step 71. Provision is made for predetermining and setting a time period that will normally permit a vehicle to pass through the intersection, step 72. This predetermined period should take into account the situation and observed behavior of drivers at the intersection. For example, if the intersection is one at which drivers tend to try to "beat the light", the time period should take this into account. If the intersection if normally clogged with vehicles waiting to make a left turn against traffic, the time period should be one after a switching of the light signals from Go to Stop, it should reasonably take into account the time it takes for the left turn vehicles to complete their turns. It is noted that this is a brief time period in addition to the alternate time period during which the respective Stop and Go signals control. Also, if the intersection is one with flashing signals, then the time period one that will permit a vehicle having the right of way in the intersection to clear the intersection.

Provision is made for the sensing of the presence of a vehicle from one of the roads in the intersection, step 73. Provision is made for signaling an alert, step 74, when a vehicle has been sensed as being in the intersection in step 73 and is still in the intersection upon the expiration of the time period as set in step 72. Provision is made for a response to an alert in step 74, for controlling the traffic signals to stop other vehicles from moving through the intersection while the sensed vehicle remains in the intersection, step 75. Also, while the vehicle remains in the intersection in a system having signal switching at alternate regular intervals, provision is made, step 76, for an override of any Go signal to a Stop signal while the vehicle remains in the intersection. Also, while the vehicle remains in the intersection in a system having flashing Stop and then Go or proceed with caution signals, Proceed signal to a Stop signal while the vehicle remains in the intersection.

Provision is also made for sensing that the vehicle sensed as being in the intersection in step 73 is no longer in the intersection, step 78; and there is provided in response to a vehicle clear sensing in step 78 for the resumption, i.e. resetting of traffic control signals to normal traffic control, step 79.

Figure 9:
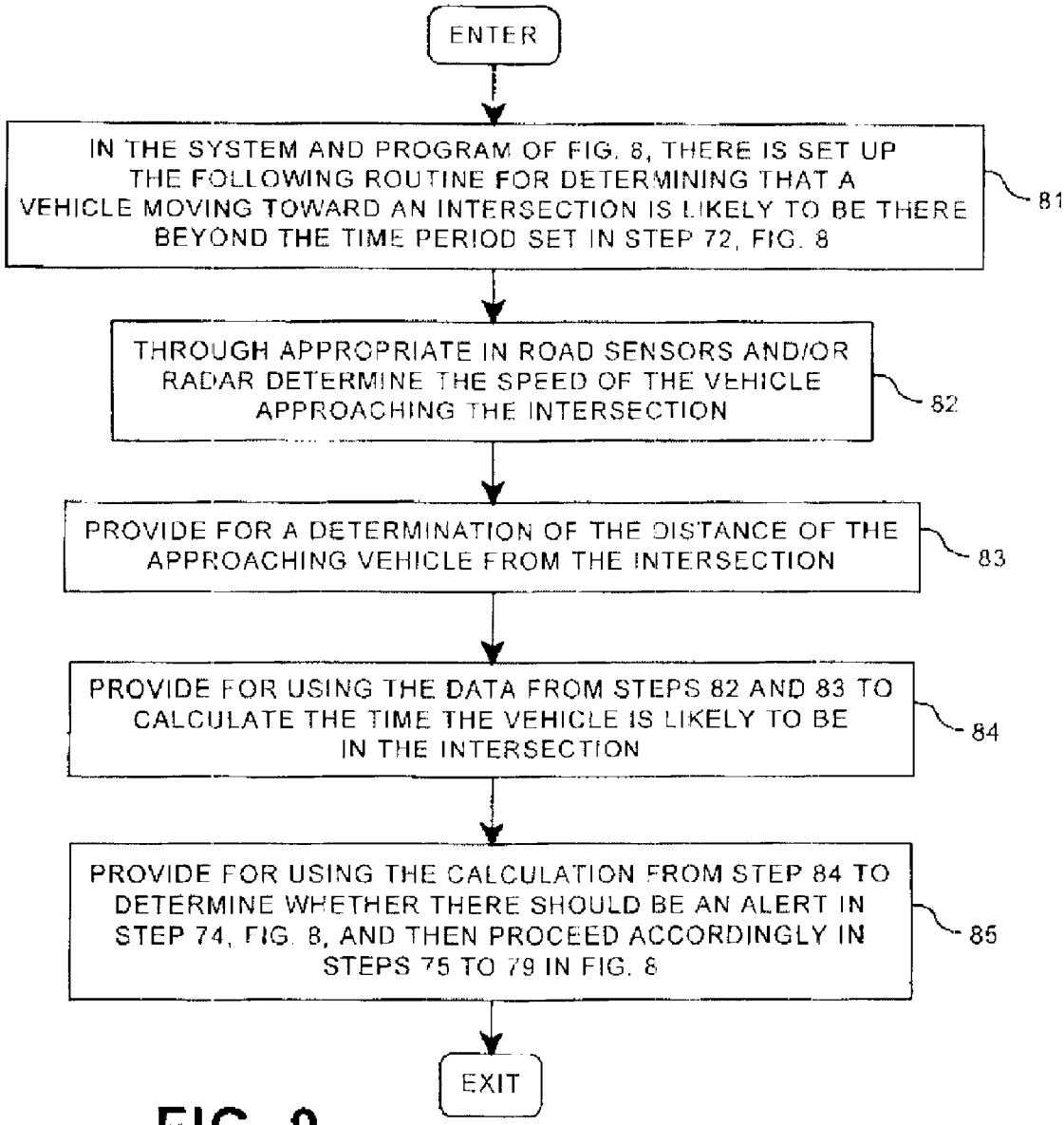
FIG. 9 is an illustrative flowchart describing the setting up of the elements needed for the program of an aspect of the invention for controlling traffic signals in response to a vehicle moving toward an intersection at such a rate of speed that it is likely to be improperly blocking the intersection.

With reference to FIG. 9, there will be described, step 81, another aspect of the system of FIG. 8 for determining that a vehicle approaching an intersection is likely to be there beyond a time period set as in step 72, FIG. 8. Through appropriate in-road sensors and/or radar, the speed of a vehicle approaching intersection is determined, step 82. Provision is made for a determination of the distance of the approaching vehicle from the intersection, step 83. The data of steps 82 and 83 may be used in the calculation of the time that the approaching vehicle is likely to be in the intersection, step 84. Finally, provision is made, step 85, for using the calculation from step 84 to determine whether there should be as alert in step 74, FIG. 8, and upon such an alert to proceed according to steps 75 through 79, FIG. 8.

Figure 10:
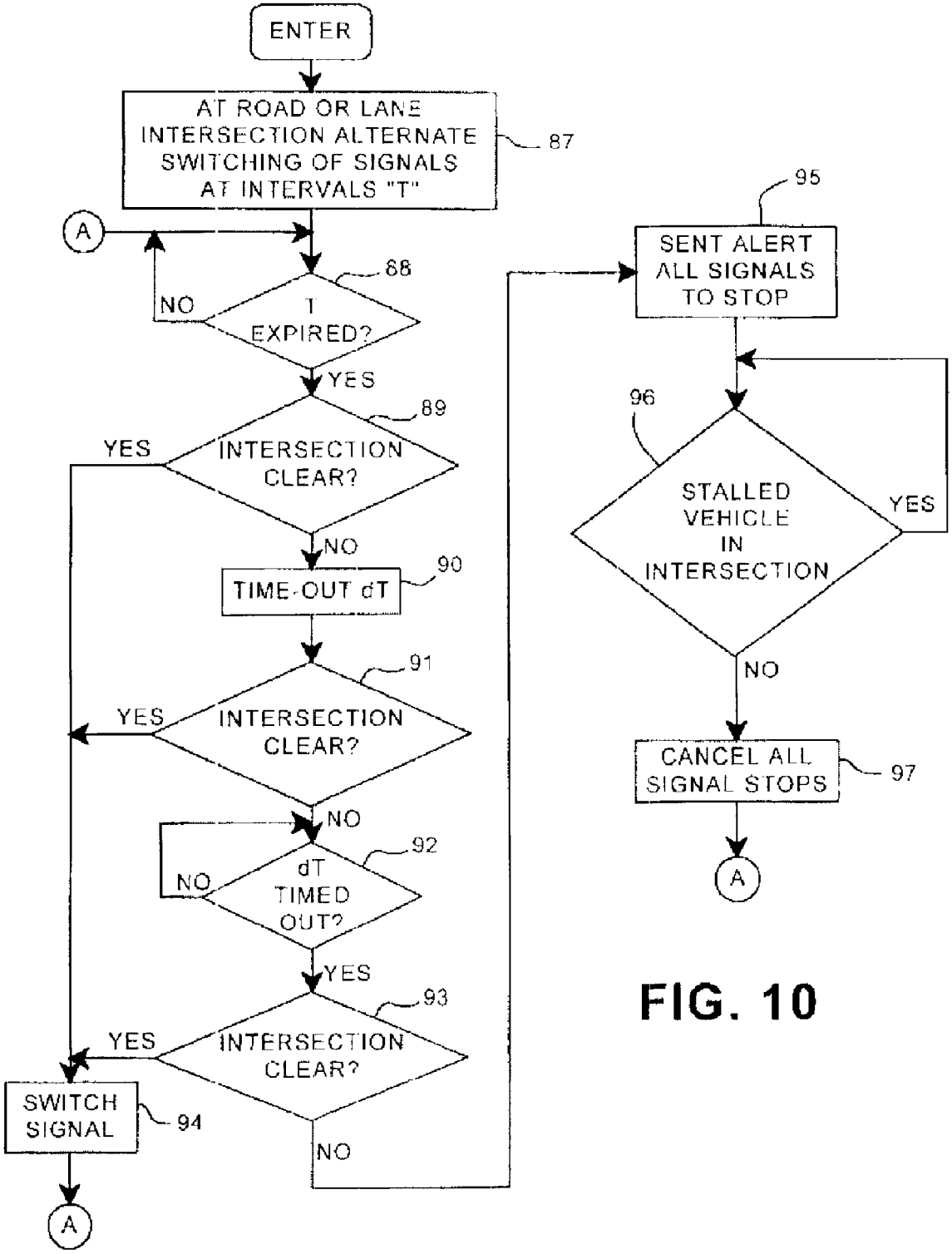
FIG. 10 is a flowchart of an illustrative simplified run of the program set up in FIG. 8.

Now, with reference to the flowchart of FIG. 10, a simplified illustrative run of the process set up in FIG. 8 will be described. At a road intersection, a signal system with alternate switching signals at intervals T, step 87 is provided. An initial determination is made as to whether T has expired, step 88. If Yes, a determination is then made as to whether the intersection is clear of vehicles, step 89. If Yes, the signal is switched, step 94, and the process returned to step 88 via branch "A". If No, then there is a time-out commenced for the additional previously described predetermined time period dT, step 90, during which a determination is made as to whether the intersection is now clear, step 91. If Yes, the signal is switched, step 94, and the process returned to step 88 via branch "A". If No, a further determination is made as to whether the period dT has timed out or been completed, step 92. If Yes, a last determination is made as to whether the intersection is now clear, step 93. If Yes, the signal is switched, step 94, and the process returned to step 88 via branch "A". If No, then, step 95, an alert is set, and signals are changed to Stop, step 95. After this point, the intersection is sensed for the presence of the vehicle which is now presumed to be stalled, step 96. If the vehicle is no longer in the intersection, then, step 97, all Stops are cancelled and the process returned to stop 88 via branch "A".

Although certain preferred embodiments have been shown and described, it will be understood that many changes and modifications may be made therein without departing from the scope and intent of the appended claims.

What is claimed is:

1. A computer controlled system for managing traffic signals at the intersection of at least two traffic lanes to avoid collisions between motor vehicles in intersecting lanes comprising:

a processor; and a computer memory holding computer program instructions which when executed by the processor perform the method comprising:

controlling traffic signals at the intersection to permit vehicles in each of the intersecting traffic lanes a predetermined time period to pass through the intersection;

detecting, with sensors external to vehicles, the presence of a vehicle in the intersection beyond the predetermined time period by detecting the presence of said vehicle for such an additional predetermined time beyond said predetermined time period so as to indicate a stalled vehicle;

controlling said traffic signals to indicate stop wherein other vehicles are stopped from passing through said intersection in response to a detection of the presence of said vehicle in said intersection;

dynamically predicting, based upon data sensed by sensors external to the vehicle, the potential presence of an approaching vehicle in said intersection beyond said predetermined time period including the step of determining the speed of the vehicle and correlating the speed with the distance from the intersection; and responsive to said prediction of the presence of said vehicle, controlling said traffic signals to indicate stop wherein other vehicles are stopped from passing through said intersection.

2. The system of claim 1 wherein said traffic signals are traffic light signals.

3. The system of claim 2, wherein said performed method further includes:

alternating said traffic signals to permit predetermined time periods to pass through for vehicles in each of the intersecting traffic lanes; and responsive to the detection of the vehicle in the intersection extending the alternate time period for pass through of said vehicle until the vehicle is no longer present in the intersection.

4. The system of claim 1, wherein said performed method further includes detecting of a subsequent passage through said intersection of the vehicle originally in said intersection.

5. A computer usable storage medium having stored thereon a non-transitory computer readable program for managing traffic signals at the intersection of at least two traffic lanes to avoid collisions between motor vehicles in intersecting lanes, wherein the computer readable program when executed on a computer causes the computer to:

control traffic signals at the intersection to permit vehicles in each of the intersecting traffic lanes a predetermined time period to pass through the intersection;

detect with sensors external to vehicles, the presence of a vehicle in the intersection beyond the predetermined time period by detecting the presence of said vehicle for such an additional predetermined time beyond said predetermined time period so as to indicate a stalled vehicle;

control said traffic signals to indicate stop wherein other vehicles are stopped from passing through said intersection in response to a detection of the presence of said vehicle in said intersection;

dynamically predict, based upon data sensed by sensors external to the vehicle, the potential presence of an approaching vehicle in said intersection beyond said predetermined time period including to determine the speed of the vehicle and correlate the speed with the distance from the intersection; and responsive to said prediction of the presence of said vehicle, control said traffic signals to indicate stop wherein other vehicles are stopped from passing through said intersection.

6. The storage medium of claim 5 wherein said traffic signals are traffic light signals.

7. The storage medium of claim 6, wherein said computer program further causes the computer to alternate said traffic signals to permit predetermined time periods to pass through for vehicles in each of the intersecting traffic lanes; and responsive to the detection of the vehicle in the intersection, extend the alternate time period for pass through of said vehicle until the vehicle is no longer present in the intersection.

8. The storage medium of claim 5, wherein said computer program when executed further causes the computer to detect of a subsequent passage through said intersection of the vehicle originally in said intersection.

* * * * *